US006926508B2

(12) United States Patent
Brady et al.

(10) Patent No.: US 6,926,508 B2
(45) Date of Patent: Aug. 9, 2005

(54) STEAM DISTRIBUTION RING FOR SPINNING MACHINES

(75) Inventors: Bobby R. Brady, Chattanooga, TN (US); Elmer L. Goshorn, Hixson, TN (US); Frank H. Overton, Signal Mountain, TN (US); Ronald E. Steele, Hixson, TN (US)

(73) Assignee: Invista North America Sarl, Wilmington, DE (US)

( * ) Notice: Subject to any disclaimer, the term of this patent is extended or adjusted under 35 U.S.C. 154(b) by 244 days.

(21) Appl. No.: 09/886,073

(22) Filed: Jun. 21, 2001

(65) Prior Publication Data

US 2002/0043733 A1 Apr. 18, 2002

Related U.S. Application Data

(60) Provisional application No. 60/213,523, filed on Jun. 23, 2000.

(51) Int. Cl.[7] ..... D01D 5/92; B29C 47/88

(52) U.S. Cl. ..... 425/72.2; 425/192 S; 425/378.2

(58) Field of Search ..... 425/72.2, 192 S, 425/378.2, 382.2, 464

(56) References Cited

U.S. PATENT DOCUMENTS 2,252,689 A * 8/1941 Bradshaw ..... 425/72.2
3,129,272 A * 4/1964 Ferrier et al. ..... 425/72.2
3,229,330 A 1/1966 Ferrier et al.
3,242,529 A * 3/1966 Parr et al. ..... 425/72.2
3,398,429 A 8/1968 Dickson, III
3,672,800 A * 6/1972 Rapisarda ..... 425/72.2
3,761,559 A 9/1973 Heckrotte et al.
3,814,559 A 6/1974 Akers, II et al.
3,907,957 A * 9/1975 Shaffer ..... 264/85
3,975,475 A * 8/1976 Foley ..... 425/464
4,462,229 A 7/1984 Lafeber et al.
5,558,826 A 9/1996 Jaegge et al.
5,661,880 A 9/1997 Schippers et al.
5,750,215 A 5/1998 Jaegge et al.
6,146,566 A * 11/2000 Beeck et al. ..... 425/192 S

* cited by examiner

*Primary Examiner*—Joseph S. Del Sole
(74) *Attorney, Agent, or Firm*—Robert B. Furr, Jr.

(57) ABSTRACT

A spinneret steam blanketing system for blanketing the face of a spinneret with gas. The system includes a steam distribution ring surrounding a filament array, where the steam distribution ring abuts the spin head and is removably mounted to said spin head. The steam distribution ring is removed and the face of the spinneret may be wiped clean, without the need for removing and replacing the spin pack.

3 Claims, 9 Drawing Sheets

STEAM DISTRIBUTION RING FOR SPINNING MACHINES

CROSS REFERENCE TO RELATED APPLICATION

This Application claims priority from and incorporates by reference in its entirety U.S. Provisional Application No. 60/213,523 filed Jun. 23, 2000.

FIELD OF THE INVENTION

The invention relates to the production of synthetic polymeric filaments and particularly to a spinneret steam blanketing apparatus for blanketing the exposed face of a spinneret with gas which is readily removable from the spin head.

DESCRIPTION OF RELATED ART

Most synthetic polymeric filaments, such as polyesters, are melt-spun, i.e., they are extruded from a heated polymeric melt. In current processes, after the freshly extruded molten filamentary streams emerge from the spinneret, they are quenched by a flow of cooling gas to accelerate their hardening. They can then be wound to form a package of continuous filament yarn or otherwise processed, e.g., collected as a bundle of parallel continuous filaments for processing, for example, as a continuous filamentary tow, for conversion into staple.

In such melt spinning operations, some of the polymer tends to build up on the spinneret face of spinning machines around each extrusion orifice and oxidizes into a hard deposit, which eventually interrupts the spinning process. Hard polymer deposits often cause newly spun filaments to bend toward these spinneret face deposits. This phenomenon is known in the art as "kneeing". The filament knee or bend is objectionable and ultimately results in a filament break. Filament breaks upset spinning performance and causes productivity loss. One solution for addressing this problem is to intermittently wipe the spinneret face to renew the surface by removing hard deposits. The time between wipes is called "wipe cycle". Minimizing the need for spinneret face wiping or equivalently extending the wipe cycle time is desirable.

Various devices have been proposed for directing inert gas across the spinneret face in an effort to exclude oxygen, thereby preventing the formation of hard polymer deposits. For example, Akers, II et al, U.S. Pat. No. 3,814,559, teaches a conventional filament extrusion spinneret blanketed with an inert gas provided by means of a metering ring disposed between a spinneret and a spinneret retainer ring. The metering ring must be sufficiently strong to support the upward force exerted by the spinneret retainer ring against the spinneret. The spinneret supports the weight of the spinning pack and seals the polymer and inert gas supplies to their respective sources against their respective pressures. Because of the retainer ring, the spinneret plate is not readily accessible, and when the spinneret face builds up polymer deposits, the spinning position must be shut down and instead of wiping the spinneret face, a new spin pack, including a spinneret, needs to be installed. This is expensive and disrupts production.

In Ferrier et al., U.S. Pat. No. 3,229,330, various ways for blanketing a spinneret face with steam are disclosed, including one method which uses a steam distribution ring, or screen. A "bottle cap" arrangement which has a serrated top edge surrounds the lower half of the pack to hold together the spinneret, the screen, and the spin pack casing. The final tightening of the spin pack against a gasket is effected by a plurality of grub screws, which are tightened against a metal bearing ring. This arrangement makes it difficult, if indeed impossible, to readily wipe the face of the spinneret. In fact, Ferrier et al. tries to completely avoid wiping the face of the spinneret, since they recognize that this interrupts production. Instead, they attempt to prevent polymer deposit build-up by using steam blanketing. If, however, this steam blanketing is not totally effective, the entire spin pack must be periodically removed to keep the face of the spinneret free from deposits. As noted above, this is expensive and disrupts production.

In FIG. 1 there is depicted a conventional spinning machine 10 with a spin pack 8 within a spin head, or spin beam, 12. A heated metallic plate 21 is attached to the bottom of the spin head. The spin pack body contains a spinneret plate 14 having a plurality of capillaries holes through which polymer is extruded. The molten polymer is extruded through the spinneret into multiple melt streams that are cooled in a quench zone 20 in any known manner to form filaments 22. Steam is supplied from an external source (not shown) through a channel 16 formed in the spin beam to an annular space 5 existing between the spin pack body 10 and the spin head 12 interior. Steam flows around the spin pack body in the annular space 5 exiting the spin head near the emerging filaments 22 and across the underside of the spin pack to the spinneret plate face. The flow of steam is in general downward surrounding the filaments 22. However, all the filaments 22 are not exposed to the same amount of steam because of inadequate flow across the spinneret face.

The prior art spin pack and steam blanketing system of FIG. 1 suffers from poor air exclusion at the spinneret face 13. In this zone the freshly extruded polymeric filaments are most susceptible to degradation by atmospheric oxygen. The entrained air flow around the fast moving filaments draws the blanketing steam away from the spinneret plate and limits the steam effectiveness at excluding oxygen. As noted above with respect to Ferrier et al., if the steam blanketing is not completely effective, the entire spin pack must be periodically removed to keep the face of the spinneret free from deposits, which is expensive and disrupts production.

Thus, there is a need in the art for a device for inert gas blanketing of a spinning machine which (1) provides inert gas blanketing control which effectively excludes oxygen at the spinneret face; (2) does not demand replacement or any modification of commercially available spinneret pack bodies; (3) is easily removed for the purpose of spinneret surface cleaning; (4) does not require robust and heavy materials of construction; and (5) is inexpensive and easy to fabricate.

SUMMARY OF THE INVENTION

The present invention solves the problems of the prior art by providing a simple device attached to the spin head to more effectively contact the spinneret face with steam and to provide a concentrated steam atmosphere to the freshly emerging polymer filaments.

The device of the present invention is particularly advantageous over the prior art in that it does not require the replacement of a spin pack to keep the face of the spinneret free of hardened polymer deposits, but rather provides easy access to the spinneret face so that it can be readily cleaned. Although wiping the face of the spinneret requires down time, replacing the spin pack requires even more down time. Thus, since the spin pack in a spinning system does not have to be replaced when the steam distribution ring of the present invention is used, the present invention improves spinning systems by reducing process down time as compared to commercially available equipment.

In addition, the apparatus of the present invention does not require substantial modification of existing equipment. Moreover, the steam distribution ring of the present invention is easy and inexpensive to fabricate.

According to one aspect of the present invention, there is provided a steam blanketing apparatus for blanketing the face of a spinneret with gas comprising a spinneret pack body including a spinneret plate having a lower face with an orifice array through which filaments are extruded; a spin head surrounding the spinneret pack body; and a steam distribution ring surrounding said array, wherein said steam distribution ring abuts the spin head. The steam distribution ring is removably mounted to the spin head.

According to another aspect of the present invention, there is provided a method for keeping the face of a spinneret free of polymer deposits, comprising removing a steam distribution ring which is removably mounted to a spin head and wiping the polymer deposits from the face of the spinneret.

DETAILED DESCRIPTION OF THE ILLUSTRATED EMBODIMENT

Figure 1:
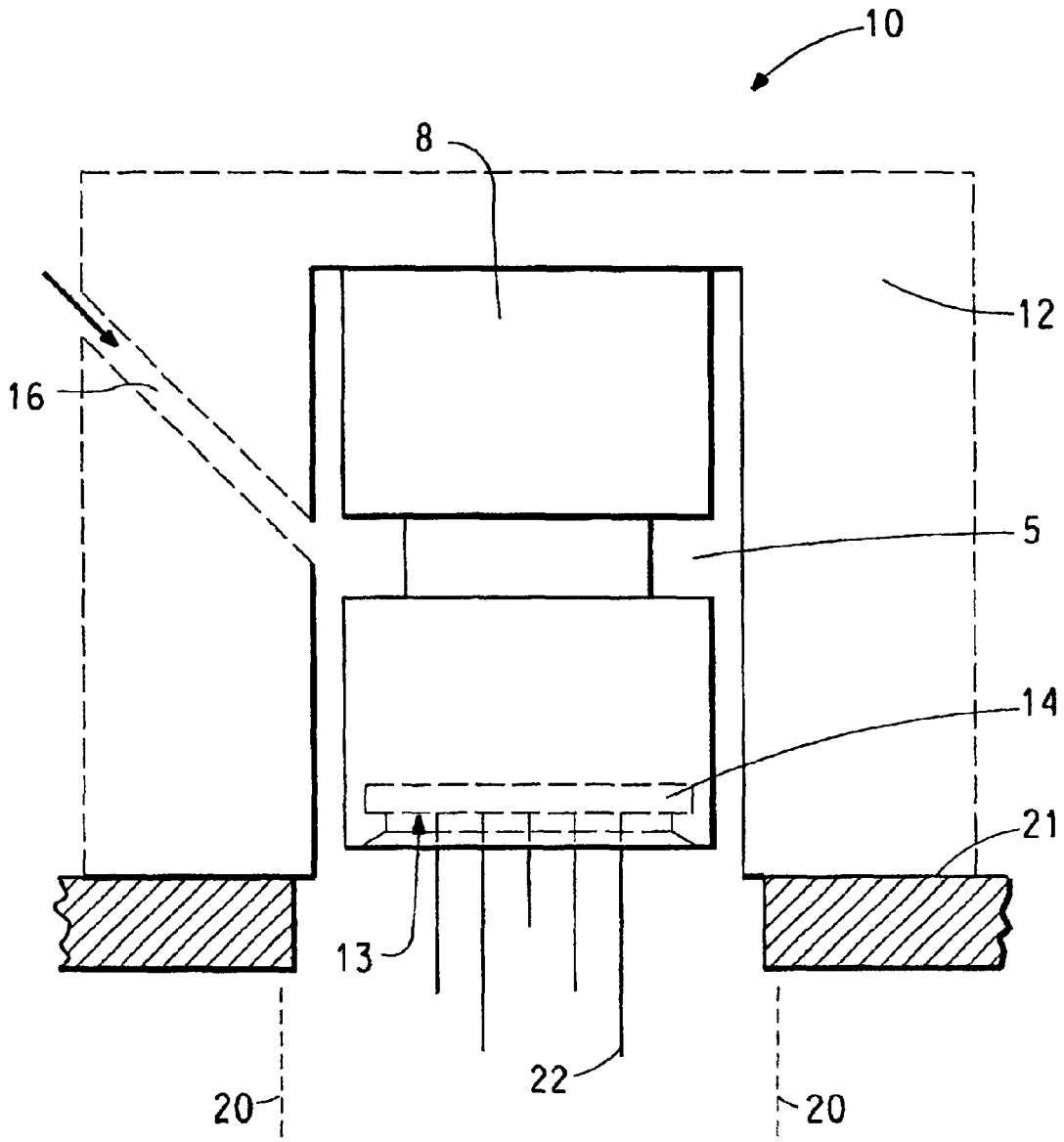
FIG. 1 (PRIOR ART)
FIG. 1 is a cut-away schematic view of a conventional spin pack within a spin head including a steam blanketing system for the spinneret face according to the prior art.

In accordance with the present invention, there is provided a device for spinning filaments from extruded molten polymer. The device is shown generally at 100 in FIG. 2. The system comprises a spinneret pack body 108 including a spinneret plate 114 having a lower face 113 through with an array of extrusion capillaries (not shown) through which polymer is extruded. The molten polymer is extruded through the spinneret into multiple melt streams that are cooled in a quench zone 120 in any known manner to form filaments 122.

The device of the present invention further includes a spin head surrounding the spinneret pack body. A spin head is shown at 112 in FIG. 2. A metallic plate 121 is located at the bottom of the spin head on both sides of the spin pack. Preferably the metallic plate is heated by any known means including thermal contact with the heated spin head.

The present invention also includes a steam distribution ring surrounding the filament array. A steam distribution ring is shown at 109 in FIG. 2. The steam distribution ring is located below the spin pack and close to the face of the spinneret. The steam distribution ring of the present invention abuts the spin head. The ring is movably mounted to the spin head. The steam distribution ring of the present invention may be movably mounted by any suitable means, so long as it redirects steam flow across the face of the spinneret. The steam distribution ring is preferably removably mounted by an interference fit within a counterbore of diameter 123 formed in plate 121 and centered on the spinneret face. The emerging filaments 122 pass through an opening in the steam distribution ring 109 concentric with the counterbore of the metallic plate.

Figure 2:
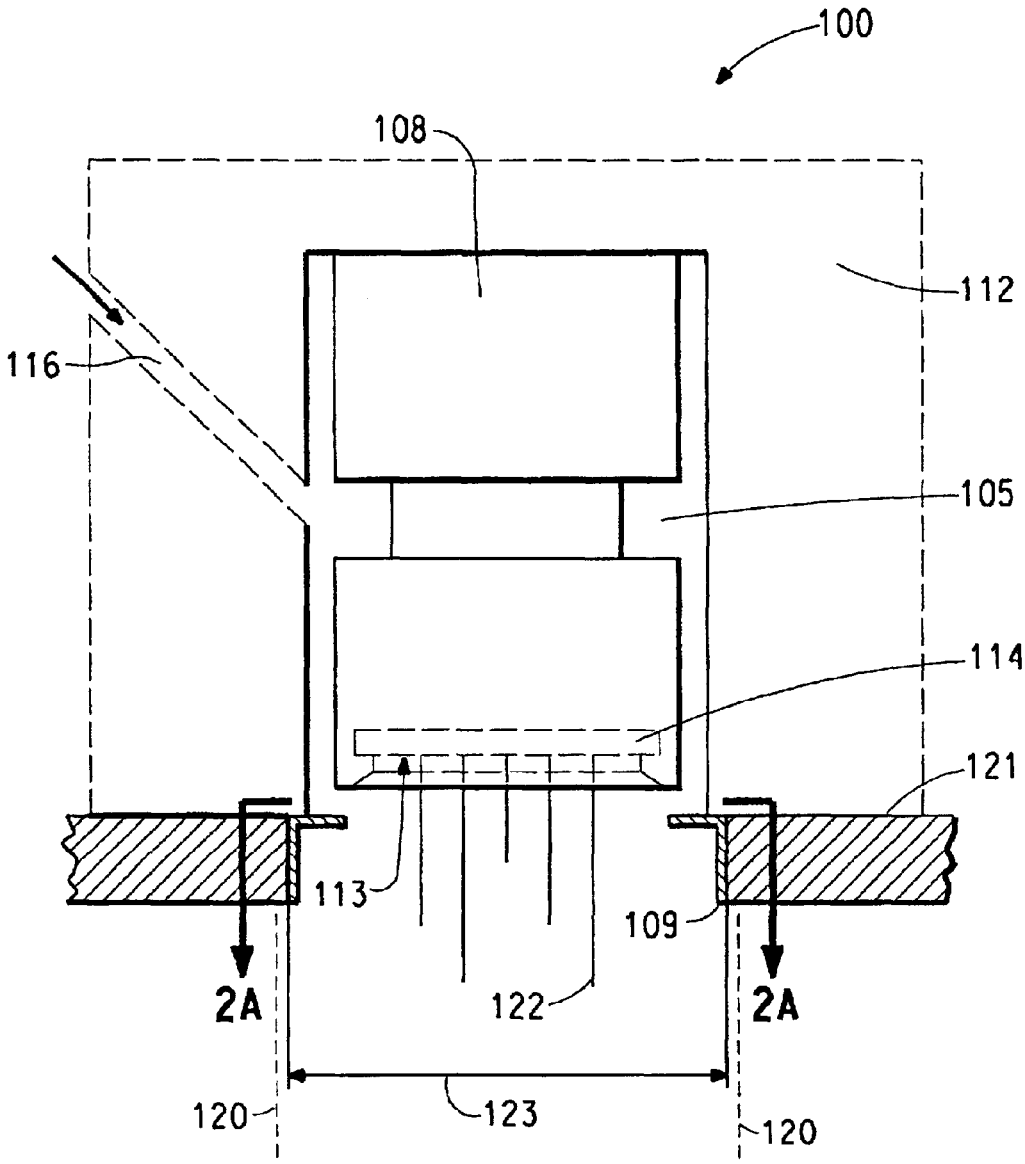
FIG. 2 is a cut-away schematic view of a spin pack within a spin head including a steam blanketing system for the spinneret face with one embodiment of a steam distribution ring according to the invention.
Figure 2A:
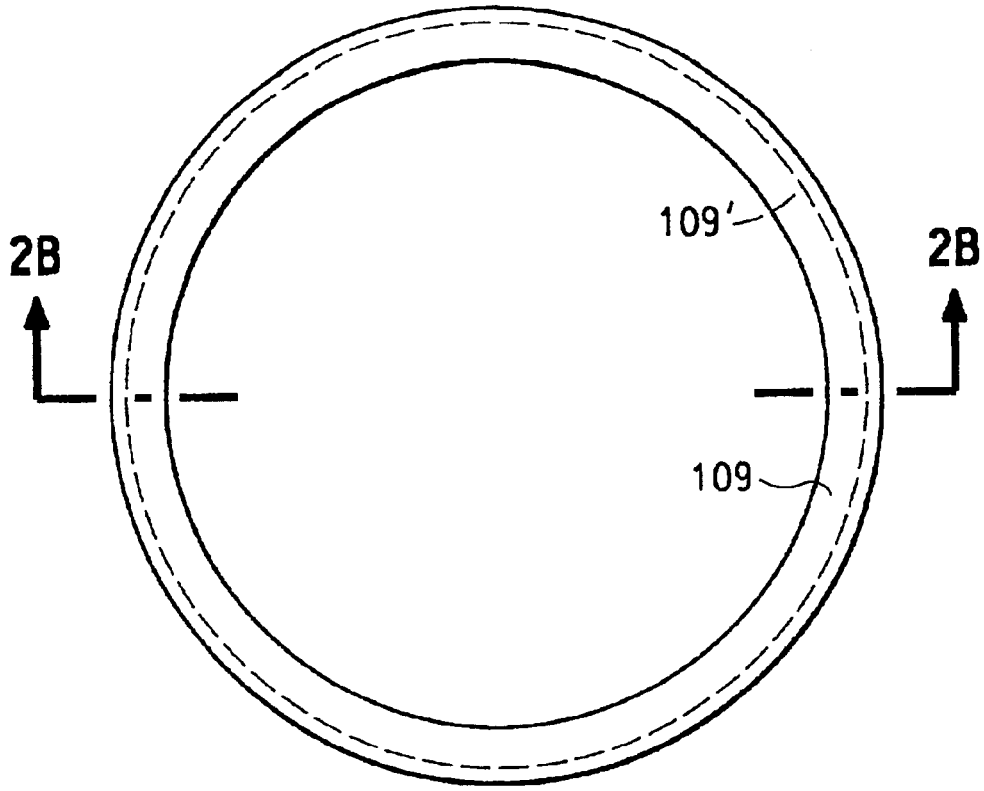
FIG. 2A is a pplan view of the steam distribution ring of FIG. 2, taken across lines 2A-sA of FIG. 2.
Figure 2B:
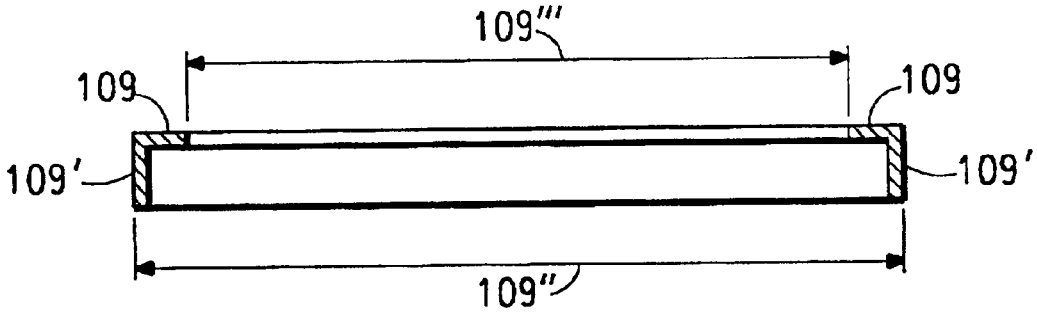
FIG. 2B is a cross-sectional view of the steam distribution ring taken across lines 2B—2B of FIG. 2A.

The steam distribution ring of the embodiment of FIG. 2 includes a skirt portion 109', as shown in FIGS. 2A and 2B. The skirt portion is generally perpendicular to the distribution ring and when mounted in the spin pack perpendicular to the spinneret plate face. By choice of the outside diameter 109" of distribution ring 109 shown in FIG. 2B, the ring can be retained solely by frictional forces (interference) within the counterbore of plate 121. One skilled in the art would know how the choice of diameter 109" is to be made once the diameter of the counterbore in plate 121 is fixed. Preferably, the distribution ring of the embodiment of FIG. 2 is soft aluminum, and one skilled in the art would also know how this choice of diameter is made in view of the rapid thermal expansion experienced by the distribution ring upon contact with the heated plate 121. In this embodiment, a flaring tool may be used to lock the steam distribution ring in the counterbore.

Figure 3:
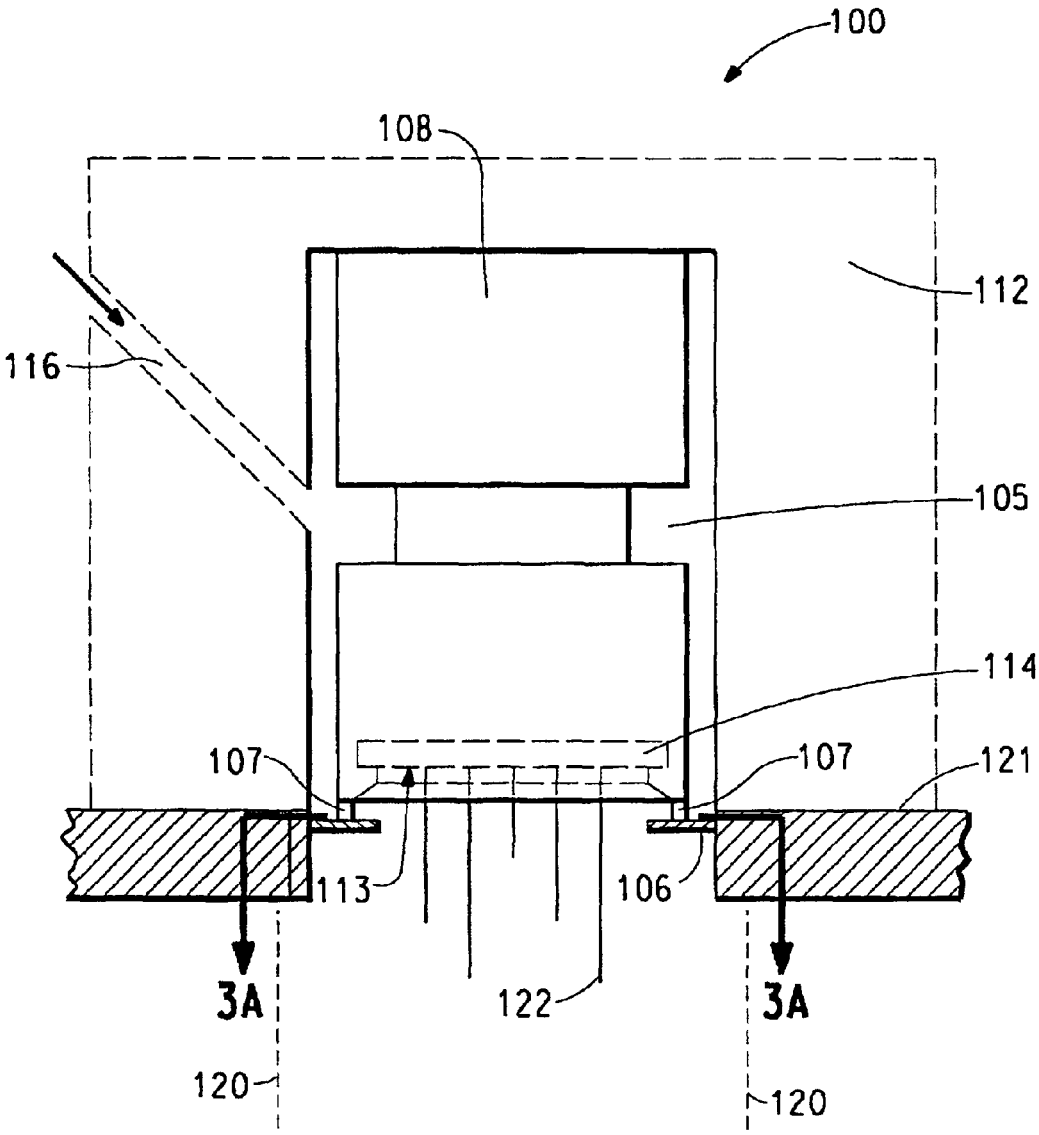
FIG. 3 is a plan view of a steam distribution ring according to another embodiment of the present invention.
Figure 3A:
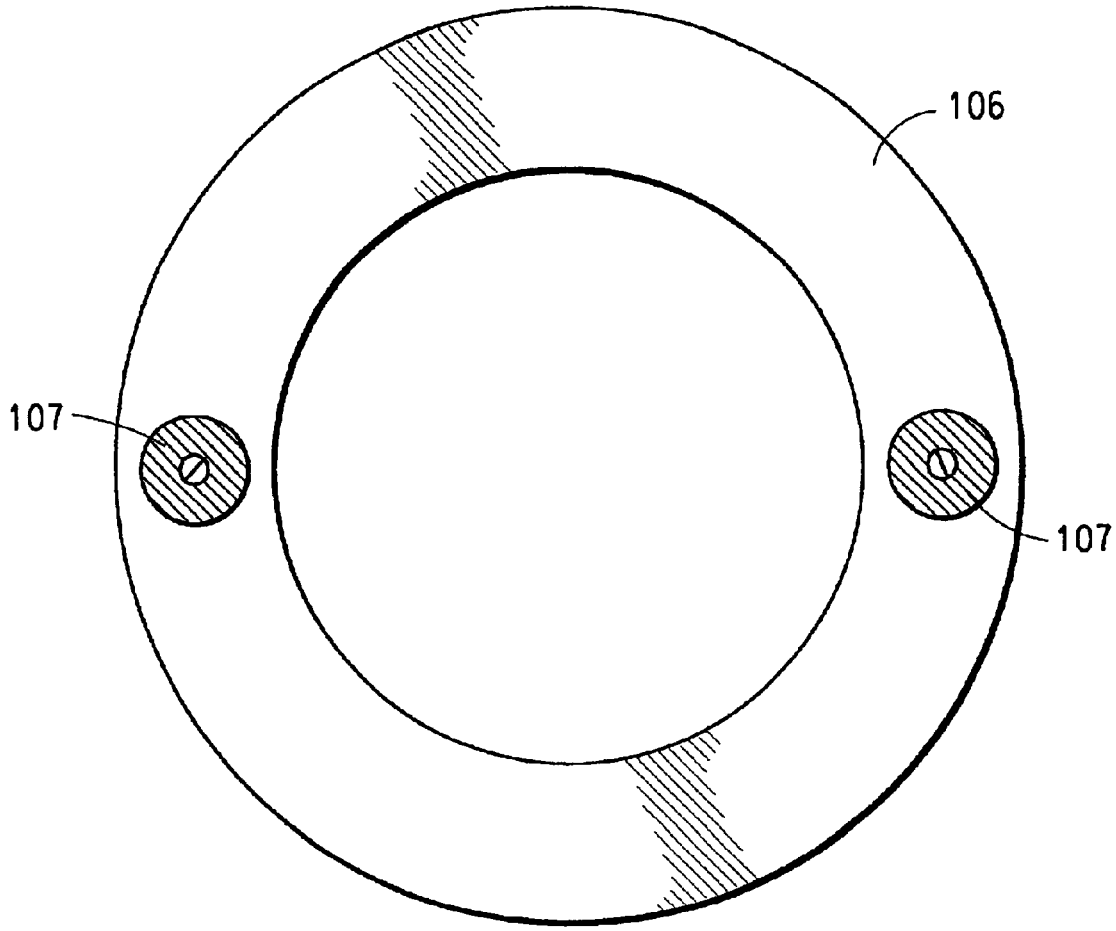
FIG. 3A is a planar view of the steam distribution ring of FIG. 3, taken across lines 3A—3A of FIG. 3.

In FIGS. 3 and 3A another embodiment of the present invention is illustrated in a cross sectional view of a spin head and spin pack, with elements like those in FIG. 2 being shown with the same reference numerals. Here a steam distribution ring 106 as shown in planar view in FIG. 3A may be constructed to include one or more magnets 107 which attach magnetically to the spin head near the face 113 of the spinneret 114. Instead of using a separate steam distribution ring and magnets, a fully magnetized material may also be used as the steam distribution ring, thus creating a continuous magnet.

Instead of any of the above configurations, the steam distribution ring of the present invention may be attached to the bottom of the spin head by other suitable mechanical means such as machine screws.

The common feature of any of the above embodiments, is that the steam distribution ring is removably mounted to the spin head, and the spinneret face is easily accessible, so that the spinneret face can be wiped clean, obviating the need for replacing a spin pack, which can be expensive. Thus, in accordance with the present invention, there is provided a method for keeping the face of a spinneret free of polymer deposits. This method comprises the steps of removing a steam distribution ring which is removably mounted to a spin head and wiping the polymer deposits from the face of the spinneret. The steam distribution ring is removed without the need for replacing the spin pack.

The steam distribution ring of the present invention may be constructed from any suitable material, such as a metal, for example, aluminum, steel, or titanium, fused silica, ceramics, sapphire or quartz. Preferably, as noted above, the steam distribution ring is made of aluminum, which has a high coefficient of thermal expansion so that it expands to fit in the counterbore.

The apparatus of the present invention may further include a valve on a steam blanketing supply line so that the steam can be shut off on the position being wiped. The shut-off valve is preferably a solenoid valve connected to an electrical switch located in closely to the spin head. Such preferred location of the electrical switch allows an operator to shut off the steam flow immediately before wiping the face of the spinneret plate. The electrical switch may preferably have a built-in timer function that will facilitate re-starting the steam flow after a predetermined amount of time. This will prevent the steam flow from being shut down for extended periods of time, which would lead to condensate forming in the supply line.

Any gas can be used to blanket the face of the spinneret. Steam is preferred for blanketing freshly extruded polymeric filaments. Inert gases like nitrogen, argon, helium and their mixtures can provide benefits similar to steam as long as the oxygen content is very low. The present invention is especially useful for steam blanketing volumes above 0.289 kg/hour/spinneret, and preferably above 0.400 kg/hour/spinneret.

Polyamides suitable for use in this invention include synthetic melt spinnable polyamide materials having recurring amide groups (—CO—NH—) as an integral part of the polymer chain. The term polyamide refers to polyamide homopolymers, copolymers, and mixtures thereof. Suitable polyamides that can be used in accordance with the invention include poly(hexamethylene adipamide) (i.e., nylon 6,6) homopolymer, poly(e-caproamide) (i.e., nylon 6) homopolymer, polydodecanolactam (i.e., nylon 12) homopolymer, poly(tetramethyleneadipamide) (i.e., nylon 4,6) homopolymer, poly(hexamethylene sebacamide) (i.e., nylon 6,10) homopolymer, the polyamide of n-dodecanedioic acid and hexamethylenediamine (i.e., nylon 6,12) homopolymer, the polyamide of dodecamethylenediamine and n-dodecanedioic acid (i.e., nylon 12,12) homopolymer, copolymers thereof, and mixtures thereof.

Illustrative polyamides include copolymers made from a dicarboxylic acid component, such as terephthalic acid, isophthalic acid, adipic acid or sebacic acid, and a diamine component, such as hexamethylenediamine, 2-methylpentamethylenediamine, or 1,4-bis(aminomethyl) cylcohexane.

The polyamides as described above can be used alone or mixed in any desired amount with other polymer synthetic fibers such as spandex, polyester and natural fibers like cotton, silk, wool or other typical companion fibers to nylon.

The present invention is not confined to polyamide filaments, but may be applied to other melt-spinnable polymers, including polyester, polyolefins, e.g., polypropylene and polyethylene. The polymers include copolymers, mixed polymers, blends, and chain-branched polymers, just as a few examples. Also the term filament is used generically, and does not necessarily exclude cut fibers (often referred to as staple), although synthetic polymers are generally prepared initially in the form of continuous polymeric filaments as they are melt-spun (extruded).

EXAMPLES

The invention will now be exemplified by the following non-limiting examples. The steam distribution ring was mounted on a conventional spinning machine, such as described in U.S. Pat. No. 5,750,215 (Steele et al.).

The Tenacity (Ten) is measured in grams (force) per yarn denier and elongation (E) is in percent.

Grams of force are equal to force in Newtons divided by 102 (grams per Newton).

Denier is equal to linear density in decitex multiplied by 9/10 (denier per decitex).

Tenacity and elongation of the yarn are used to show the superior properties provided to the product by the use of the steam blanketing distribution ring. They are measured according to ASTM D2256 using a 10 in (25.4 cm) gauge length sample, at 65% RH and 70 degrees F., at an elongation rate of 60% per min. Elongation to break is measured according to ASTM D955.

A "quality index" is defined to be the square root of the quantity percent elongation multiplied by tenacity.

$$\text{"quality index"} = [\%\ \text{elongation X tenacity (grams/denier)}]^{1/2}$$

Polymer degradation products collecting near the spinneret capillary opening and near the emerging filament are often present. Newly spun filaments, in time, bend toward these spinneret face deposits. This phenomenon is also known in the art as "kneeing" or bent filaments.

A "bent filament" metric (a direct count of bent filaments versus the total number of filaments per spinneret expressed as per cent) is used to evaluate the performance of the steam distribution ring. Additionally, a wipe cycle is defined as the time between spinneret wipes (equivalent to "wipe life" and expressed in hours). Wipes are required to renew the spinneret surface after some period of filament spinning. Wipe life, a comparison of wipe cycle performance of a conventional steam blanketing system to that of a system modified with the invention is another measure of performance for the invention.

Example 1

Example 1 compares a spinning machine which includes a steam blanketing distribution ring according to the embodiment of FIG. 2 of the present invention versus a conventional spinning machine without steam blanketing and with prior art spinneret steam blanketing, provided as shown in FIG. 1 herein. The distribution ring used in this Example had dimensions of 91 mm (outside diameter 109" in FIG. 2B) and 70 mm for the aperture (diameter 109'" in FIG. 2B). The polymer in this example was nylon 66 with an initial formic acid relative viscosity of between 53 and 58. The polymer contained titanium dioxide delusterant at a concentration of 0.3% by weight. Forty filaments per yarn were spun at a drawn denier of 34 per yarn, and the overall process draw ratio was 1.25. Yarns were wound up onto a tube core 120 at a surface speed of 6400 meters per minute. The process and apparatus used in this example was similar to that of Example 2 of U.S. Pat. No. 5,750,215 (Steele et al.).

Figure 4:
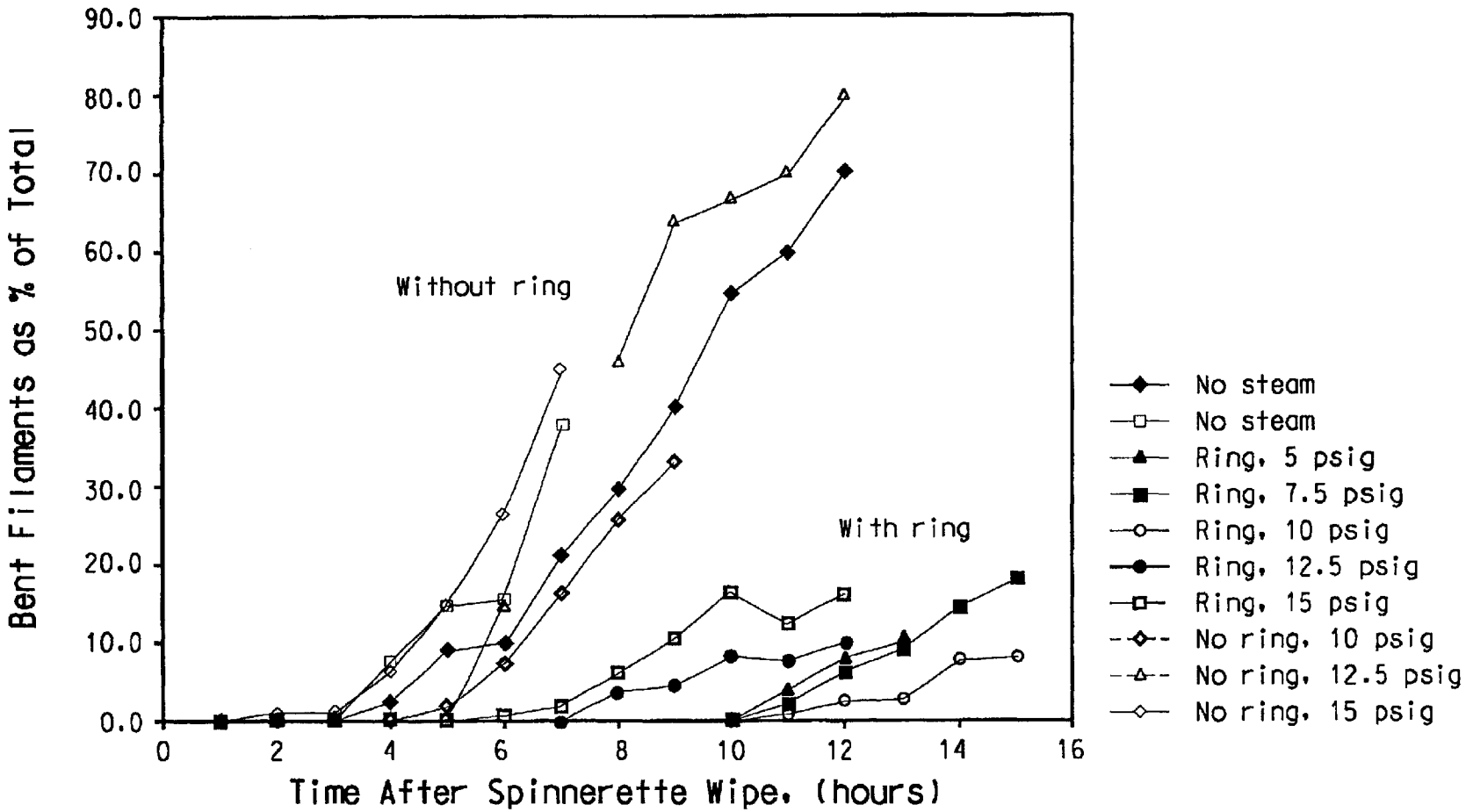
FIG. 4 is a chart comparing bent filaments as % of total versus time after spinneret wipe.

The test involved wiping the spinneret and recording the number of bent filaments as a function of time. The results are shown in Table 1 and FIG. 4. Without spinneret steam blanketing (Runs A and B), bent filaments started to appear after only 4 hours of operation with more than 10% of the filaments being affected after 5 to 6 hours of operation. In the system with spinneret steam blanketing but without the steam distribution ring of the present invention (Runs H, I and J), bent filaments started to appear after 5 to 6 hours of operation with more than 10% of the filaments being affected after 6 to 7 hours of operation. With both spinneret steam blanketing and the steam distribution ring according to the invention (Runs C, D, E, F, and G), bent filaments started to appear after 9 to 11 hours of operation with more than 10% of the filaments being affected between 13 and 15 hours depending on steam pressure. All of the spinneret steam blanketing items at steam pressures greater than 12.5 psig showed deterioration in wipe life likely due to the difficulty in getting a good initial spinneret wipe.

The tests show that the spinneret steam blanketing on conventional equipment only marginally improves the spinneret wipe life. The addition of the steam distribution ring of the present invention significantly improved the spinneret wipe life by a factor of 2 to 3 times that of steam blanketing alone.

TABLE 1

| | A | | B | | C | | D | |
|---|---|---|---|---|---|---|---|---|
| Item | Number of bent fil. | Bent fil. % of total | Number of bent fil. | Bent fil. % of total | Number of bent fil. | Bent fil. % of total | Number of bent fil. | Bent fil. % of total |
| Position | 1 | | 2 | | 2 | | 2 | |
| Steam pressure | None | | None | | 5 psig | | 7.5 psig | |
| Steam ring? | No | | No | | Yes | | Yes | |
| # of packs | 8 | | 8 | | 8 | | 8 | |
| Hours after wipe | | | | | | | | |
| 1 | 0 | 0.0 | 0.0 | 0.0 | 0 | 0.0 | 0 | 0.0 |
| 2 | 0 | 0.0 | 0.0 | 0.0 | 0 | 0.0 | 0 | 0.0 |
| 3 | 0 | 0.0 | 0.0 | 0.0 | 0 | 0.0 | 0 | 0.0 |
| 4 | 6 | 2.2 | 21.0 | 7.7 | 0 | 0.0 | 0 | 0.0 |
| 5 | 24 | 8.8 | 38.0 | 14.0 | 0 | 0.0 | 0 | 0.0 |
| 6 | 29 | 10.7 | 41.0 | 15.1 | 0 | 0.0 | 0 | 0.0 |
| 7 | 59 | 21.7 | 100.0 | 36.8 | 0 | 0.0 | 0 | 0.0 |
| 8 | 80 | 29.4 | | | 0 | 0.0 | 0 | 0.0 |
| 9 | 110 | 40.4 | | 0 | 1 | 0.4 | 0 | 0.0 |
| 10 | 148 | 54.4 | | | 0 | 0.0 | 0 | 0.0 |
| 11 | 165 | 60.7 | | | 9 | 3.3 | 5 | 1.8 |
| 12 | 192 | 70.6 | | | 21 | 7.7 | 16 | 5.9 |
| 13 | | | | | 28 | 10.3 | 26 | 9.6 |
| 14 | | | | | | | 40 | 14.7 |
| 15 | | | | | | | 47 | 17.3 |

TABLE 1-continued

| | E | | F | | G | | H | |
|---|---|---|---|---|---|---|---|---|
| Item | Number of bent fil. | Bent fil. % of total | Number of bent fil. | Bent fil. % of total | Number of bent fil. | Bent fil. % of total | Number of bent fil. | Bent fil. % of total |
| Position | 2 | | 2 | | 2 | | 1 | |
| Steam pressure | 10 psig | | 12.5 psig | | 15 psig | | 10 psig | |
| Steam ring? | Yes | | Yes | | Yes | | No | |
| # of packs | 8 | | 8 | | 8 | | 4 | |
| Hours after wipe | | | | | | | | |
| 1 | 0 | 0.0 | 0 | 0.0 | 0 | 0.0 | 0 | 0.0 |
| 2 | 0 | 0.0 | 0 | 0.0 | 0 | 0.0 | 0 | 0.0 |
| 3 | 0 | 0.0 | 0 | 0.0 | 0 | 0.0 | 0 | 0.0 |
| 4 | 0 | 0.0 | 0 | 0.0 | 0 | 0.0 | 0 | 0.0 |
| 5 | 0 | 0.0 | 0 | 0.0 | 0 | 0.0 | 2 | 1.5 |
| 6 | 0 | 0.0 | 0 | 0.0 | 1 | 0.4 | 11 | 8.1 |
| 7 | 0 | 0.0 | 0 | 0.0 | 4 | 1.5 | 23 | 16.9 |
| 8 | 0 | 0.0 | 11 | 4.0 | 17 | 6.3 | 35 | 25.7 |
| 9 | 0 | 0.0 | 12 | 4.4 | 29 | 10.7 | 45 | 33.1 |
| 10 | 0 | 0.0 | 20 | 7.4 | 45 | 16.5 | | |
| 11 | 2 | 0.7 | 19 | 7.0 | 33 | 12.1 | | |
| 12 | 6 | 2.2 | 26 | 9.6 | 46 | 16.9 | | |
| 13 | 7 | 2.6 | | | | | | |
| 14 | 19 | 7.0 | | | | | | |
| 15 | 20 | 7.4 | | | | | | |

| | I | | J | |
|---|---|---|---|---|
| Item | Number of bent filaments | Bent filaments % of total | Number of bent filaments | Bent filaments % of total |
| Position | 1 | | 1 | |
| Steam pressure | 12.5 psig | | 15 psig | |
| Steam distribution ring? | No | | No | |
| Number of packs | 4 | | 8 | |
| Hours after wipe | | | | |
| 1 | 0 | 0.0 | 0 | 0.0 |
| 2 | 0 | 0.0 | 2 | 0.7 |
| 3 | 0 | 0.0 | 2 | 0.7 |
| 4 | 0 | 0.0 | 18 | 6.6 |
| 5 | 0 | 0.0 | 39 | 14.3 |
| 6 | 19 | 14.0 | 72 | 26.5 |
| 7 | | | 119 | 43.8 |
| 8 | 63 | 46.3 | | |
| 9 | 86 | 63.2 | | |
| 10 | 91 | 66.9 | | |
| 11 | 96 | 70.6 | | |
| 12 | 108 | 79.4 | | |
| 13 | | | | |
| 14 | | | | |
| 15 | | | | |
| 16 | | | | |

Example 2

This Example was performed according to Example 1, and with the steam distribution ring of the present invention. This Example shows that the use of the steam distribution ring of the present invention with spinneret steam blanketing results in an increase in tenacity and elongation in the filaments compared to the use of spinneret steam blanketing without the steam ring. This resulted in an improvement in quality, Q, of the yarn through the use of the steam distribution ring.

Figure 5:
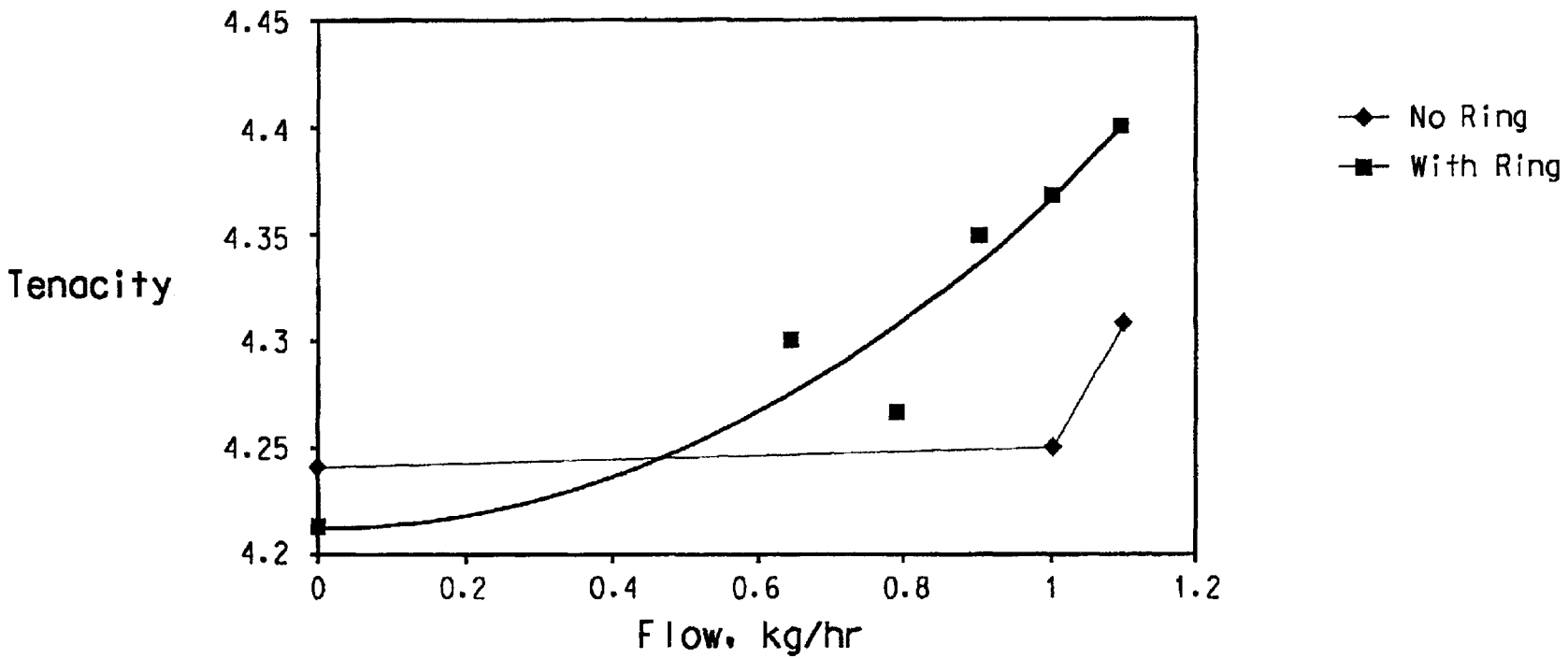
FIG. 5 is a chart comparing steam flow versus filament tenacity.
Figure 6:
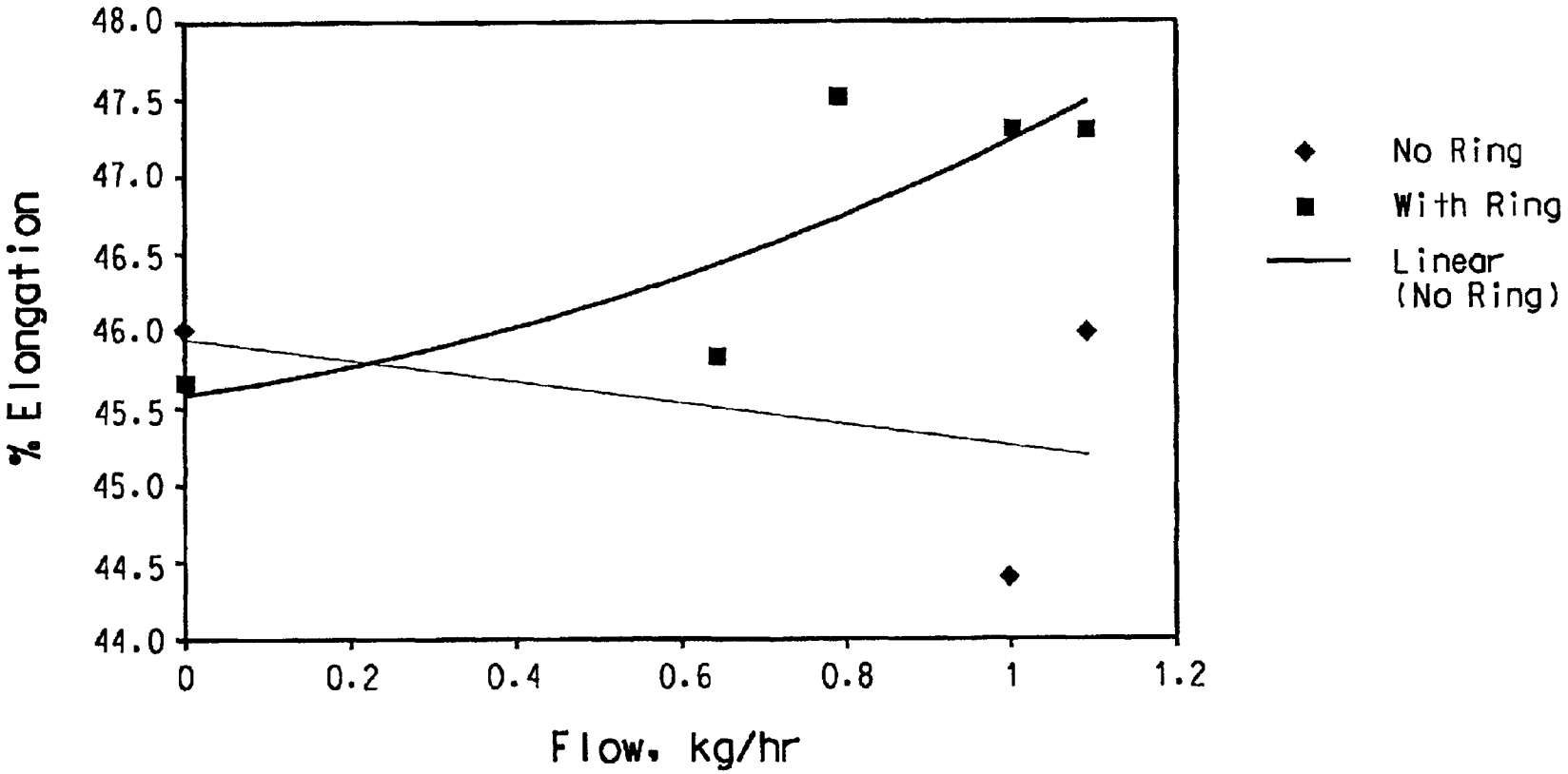
FIG. 6 is a chart comparing steam flow versus filament elongation to break.
Figure 7:
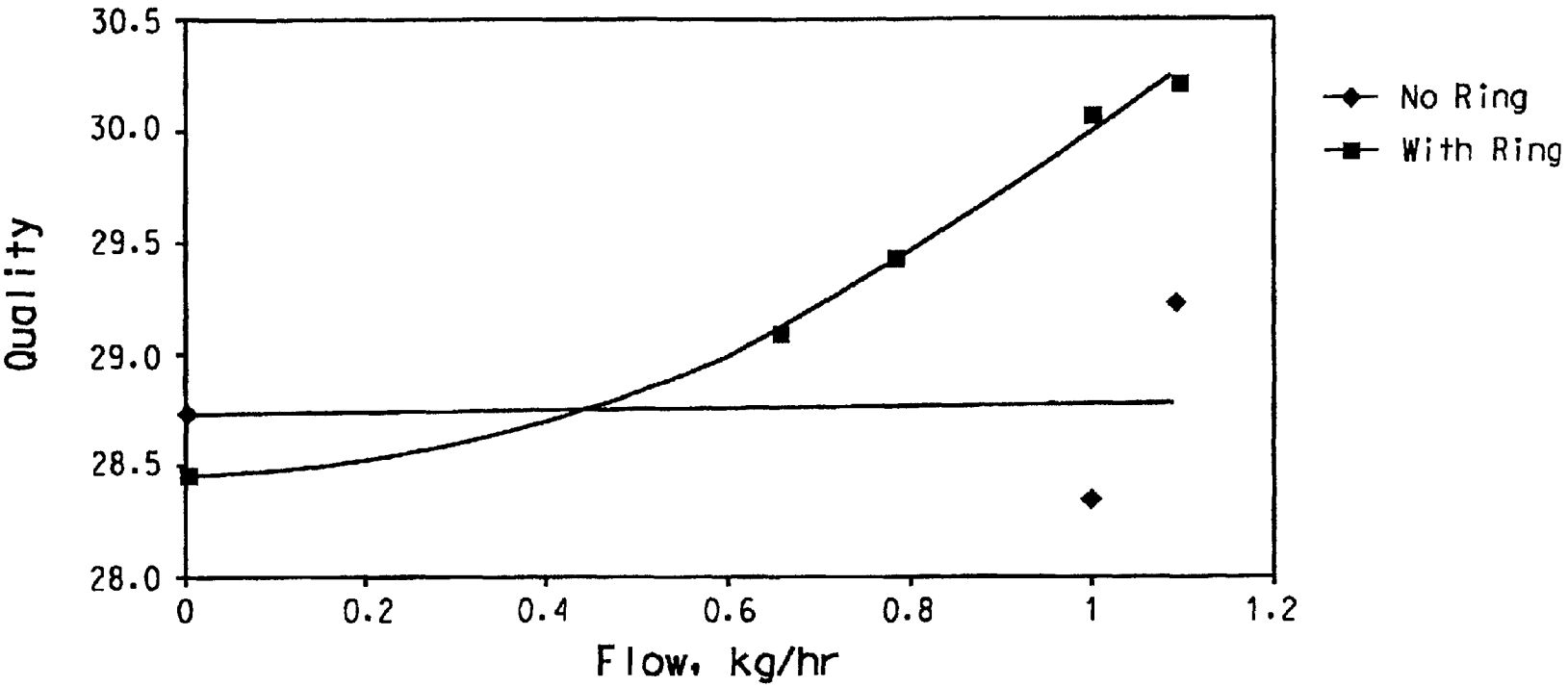
FIG. 7 is a chart comparing steam flow versus filament quality.

The data obtained in Examples 1 and 2 are compared in three ways shown in FIGS. 5, 6, and 7. First, in FIG. 5, the yarn tenacity is plotted versus the steam flow to the steam blanketing system. In every case where the steam distribution ring was used, and steam was flowing to the steam blanketing system, the yarn tenacity was superior to that of the control. Next, in FIG. 6, the yarn elongation to break is plotted versus the steam flow to the steam blanketing system. In cases where the steam distribution ring was used and steam was flowing to the steam blanketing system, the yarn elongation to break was superior to that of the control. Finally, in FIG. 7 the quality of the yarn (as defined in the equation above) is plotted versus the steam flow to the steam blanketing system. Quality is a geometric mean of significant yarn performance-in-use parameters. FIG. 7 shows quality versus steam flow to the steam blanketing system. In FIG. 7 quality was shown to be superior (higher) for each measurement where the steam distribution ring was used and steam was flowing to the steam blanketing system.

Although the invention has been described above in detail for the purpose of illustration, it is understood that the skilled artisan may make numerous variations and alterations without departing from the spirit and scope of the invention defined by the following claims.

What is claimed is:

1. A steam blanket apparatus for blanketing the face of a spinneret with gas comprising:

a spinneret pack body including a spinneret plate having a lower face with an orifice array through which filaments are extruded;

a spin head surrounding the spinneret pack body and defining interior walls, wherein the spin head includes a metallic plate extending below the spinneret pack body;

an annular space disposed between the interior walls of the spin head and the spinneret pack body;

an external supply source of gas to supply steam into the annular space, such that the steam flows in the annular space around the spinneret pack body and along the spinneret pack body in a primarily downward axial direction; and a steam distribution ring abutting the spin head and removably mounted to the spin head, the steam distribution ring including a skirt portion generally perpendicular to the distribution ring and situated to deflect the flow of steam from the annular space toward the spinneret orifice array and wherein the steam distribution ring is removable from the spin head without removing the spinneret pack body from the spin head.

2. The apparatus of claim 1, wherein the steam distribution ring is located in a counterbore formed in the spin head plate.

3. The apparatus of claim 1, wherein the steam distribution ring is fabricated from aluminum.

* * * * *